US006868812B2

(12) United States Patent
Saito et al.

(10) Patent No.: US 6,868,812 B2
(45) Date of Patent: Mar. 22, 2005

(54) VALVE TIMING CONTROL SYSTEM FOR INTERNAL COMBUSTION ENGINE

(75) Inventors: Masaharu Saito, Kanagawa (JP); Hideaki Nakamura, Farmington Hills, MI (US); Katsuhiko Uchida, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 67 days.

(21) Appl. No.: 09/985,798

(22) Filed: Nov. 6, 2001

(65) Prior Publication Data

US 2002/0062802 A1 May 30, 2002

(30) Foreign Application Priority Data

Nov. 28, 2000 (JP) ..... 2000-360519
Aug. 28, 2001 (JP) ..... 2001-257302

(51) Int. Cl.[7] ..... F01L 1/34
(52) U.S. Cl. ..... 123/90.17; 123/90.15; 73/116
(58) Field of Search ..... 123/90.15–90.18, 123/90.31; 73/116, 117.2, 117.3, 118.1; 324/207.24, 173, 174, 207.25

(56) References Cited

U.S. PATENT DOCUMENTS 5,209,202 A * 5/1993 Maurer et al. ..... 123/406.18
5,559,705 A * 9/1996 McClish et al. ..... 701/110
5,736,633 A * 4/1998 Magner et al. ..... 73/116
5,957,095 A * 9/1999 Kako ..... 123/90.15
6,308,672 B1 * 10/2001 Lichti et al. ..... 123/90.17
6,378,358 B1 * 4/2002 Hirakata et al. ..... 73/117.3

FOREIGN PATENT DOCUMENTS

JP 10-252420 9/1998

* cited by examiner

*Primary Examiner*—Thomas Denion
*Assistant Examiner*—Jaime Corrigan
(74) *Attorney, Agent, or Firm*—Foley & Lardner LLP

(57) ABSTRACT

A valve timing control system for an internal combustion engine has: a drive force transmitter or a chain sprocket; a cam shaft; a housing, a vane rotor; an advanced angle chamber and a delayed angle chamber; an oil pressure conveyer; a protrusion shaft; a target plate; and a sensor. The protrusion shaft is formed on at least one of the vane rotor and the housing, and protrudes forward. The target plate is mounted on at least one of the vane rotor and the housing. The target plate is formed substantially flat through a press molding, and is press fitted to the protrusion shaft. The target plate has a plurality of detector protrusions and one index protrusion. The detector protrusion and the index protrusion are equal in width.

7 Claims, 10 Drawing Sheets

VALVE TIMING CONTROL SYSTEM FOR INTERNAL COMBUSTION ENGINE

BACKGROUND OF THE INVENTION

1. Field of the Invention

The present invention relates to a valve timing control system for controlling timing of opening and closing an intake valve and an exhaust valve of an internal combustion engine, in accordance with an operation of the internal combustion engine. Above all, the present invention relates to the valve timing control system provided with a mechanism for detecting a rotational position of a cam shaft and the like.

2. Description of the Related Art

Japanese Patent Unexamined Publication No. Heisei 10 (1998)-252420 discloses a valve timing control system for varying timing for opening and closing an intake valve and an exhaust valve, by adjusting an angle for fitting a drive force transmitter to a cam shaft; where the drive force transmitter (such as a timing pulley and a chain sprocket) is rotatable synchronously with a crank shaft of an internal combustion engine, and the cam shaft has an external periphery formed with a drive cam.

As is seen in FIG. 14, the valve timing control system according to Japanese Patent Unexamined Publication No. Heisei 10 (1998)-252420 has a target plate 2 at a front end (left end in FIG. 14) of a vane rotor 1. Target plate 2 has a plate body 5 and a bottomed cylindrical wall 6. Plate body 5 is toroidal, and is formed with a plurality of protrusions 5A extending radially outward. Bottomed cylindrical wall 6 extends on an internal periphery of plate body 5, and has a bottom section which is integrally coupled to vane rotor 1 with a cam bolt 7. Moreover, bottomed cylindrical wall 6 has a cylindrical section protruding from a housing 8. Plate body 5 at a head end (left end in FIG. 14) of the cylindrical section of bottomed cylindrical wall 6 is disposed on a front side of housing 8.

Each of protrusions 5A of target plate 2 changes a detection wave form which is detected by sensor 3 when running across a front surface of sensor 3. One of protrusions 5A is wider than the other protrusions 5A for sensor 3 to make a distinction. In other words, with the valve timing control system in FIG. 14, wider protrusion 5A can be distinguished from the other protrusions 5A referring to a difference in the detection wave form. The other protrusions 5A can be distinguished by counting the number of detection waves after wider protrusion 5A has been detected.

In the valve timing control system in FIG. 14, however, the internal periphery of plate body 5 of target plate 2 is formed with bottomed cylindrical wall 6 that is connected to vane rotor 1 with cam bolt 7. Formation of bottomed cylindrical wall 6 makes it difficult to produce target plate 2. Obtaining good products with precise (and/or accurate) dimension requires increase in production cost.

For reducing production cost, target plate 2 is ordinarily formed through a press molding. Target plate 2 in FIG. 14 requires a drawing during the press molding for forming bottomed cylindrical wall 6 on the internal periphery of plate body 5. However, obtaining good dimensional precision (and/or accuracy) of bottomed cylindrical wall 6 in the axial direction is of difficulty only through the drawing, and thereby requires another machining of bottomed cylindrical wall 6 in the latter production step.

Target plate 2 of the valve timing control system in FIG. 14 (or ones similar to target plate 2) is preferably light in weight so as to prevent failures such as rotational shift (of target plate 2) attributable to an inertial force.

Therefore, for reduction in weight, target plate 2 of the valve timing control system in FIG. 14 has the toroid (in the vicinity of the center) as small as possible, leaving a long extension of radial protrusions 5A. However, one of protrusions 5A considerably wider (for distinction) than the other protrusions 5A restricts the reduction of target plate 2 in weight.

BRIEF SUMMARY OF THE INVENTION

It is therefore an object of the present invention to provide a valve timing control system for an internal combustion engine having a target plate which is formed with ease for reducing production cost.

According to a first aspect of the present invention, there is provided a valve timing control system for an internal combustion engine. The valve timing control system comprises: a drive force transmitter or a chain sprocket; a cam shaft; a housing, a vane rotor; an advanced angle chamber and a delayed angle chamber; an oil pressure conveyer; a protrusion shaft; a target plate; and a sensor. The protrusion shaft is formed on at least one of the vane rotor and the housing, and protrudes forward. The target plate is mounted on at least one of the vane rotor and the housing. The target plate is formed substantially flat through a press molding, and is press fitted to the protrusion shaft.

According to a second aspect of the present invention, there is provided a valve timing control system for the internal combustion engine. The valve timing control system comprises: a drive force transmitter or a chain sprocket; a cam shaft; a rotation control mechanism; a target plate; and a sensor. The target plate comprises: a plurality of detector protrusions and one index protrusion. The detector protrusions protrude radially outward, and are disposed at regular angular intervals circumferentially on the target plate. The detector protrusions are substantially equal in width, each two of the detector protrusions defining therebetween a first pulse interval of a detection signal. The one index protrusion protrudes radially outward, and is disposed between two of the detector protrusions that are predetermined and adjacent to the one index protrusion. The one index protrusion is substantially equal in width to any one of the detector protrusions. The one index protrusion and the any one of the detector protrusions define therebetween a second pulse interval of the detection signal. The second pulse interval is shorter than the first pulse interval. The sensor detects the plurality of the detector protrusions and the one index protrusion of the target plate, so as to detect a rotational position of the drive force transmitter and a rotational position of the cam shaft.

The other objects and features of the present invention will become understood from the following description with reference to the accompanying drawings.

DETAILED DESCRIPTION OF THE EMBODIMENT

As is seen in FIG. 1 to FIG. 5, there is provided a valve timing control system 12 for an internal combustion engine, according to a first embodiment of the present invention.

Figure 1:
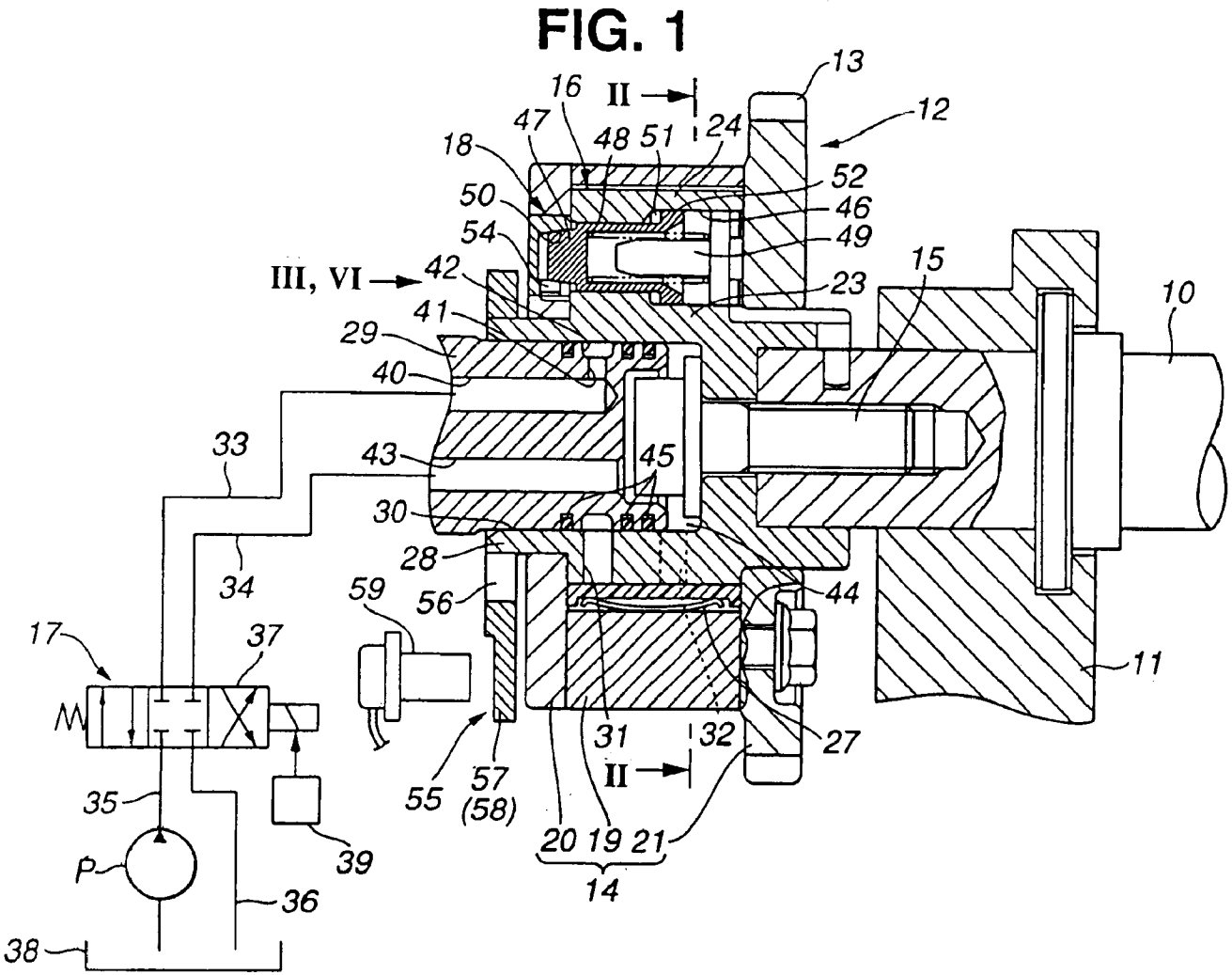
FIG. 1 is an overall view of a valve timing control system 12 showing a cross section taken along lines I—I in FIG. 2, according to a first embodiment of the present invention.

As is seen in FIG. 1, there is provided a cam shaft 10 of the internal combustion engine. Cam shaft 10 is rotatably supported to a cylinder head 11 by way of a bearing. Moreover, cam shaft 10 has a main section defining an external periphery which is formed with a drive cam (not shown) for opening and closing an intake valve (engine valve). Valve timing control system 12 under the present invention is disposed at a forward end (left in FIG. 1) of cam shaft 10.

Valve timing control system 12 is provided with a chain sprocket 13, a housing 14, cam shaft 10, a vane rotor 16, an oil pressure conveyer 17, and a lock mechanism 18.

Chain sprocket 13 is a drive force transmitter which is rotatably driven, by way of a timing chain (not shown) and the like, by means of a crank shaft (not shown) of the internal combustion engine. Chain sprocket 13 is formed integrally with housing 14. Cam shaft 10 has a first end (left in FIG. 1) which is so fitted with housing 14 as to rotate housing 14 when so required. Vane rotor 16 is integrally coupled to the first end of cam shaft 10 with a cam bolt 15, and is rotatably housed in housing 14. Oil pressure conveyer 17 conveys an oil pressure so as to rotate vane rotor 16 in a first direction and a second direction (opposite to the first direction), in accordance with an operating condition of the internal combustion engine. Lock mechanism 18 controls rotation of housing 14 relative to vane rotor 16, in situations such as when starting the internal combustion engine.

Figure 2:
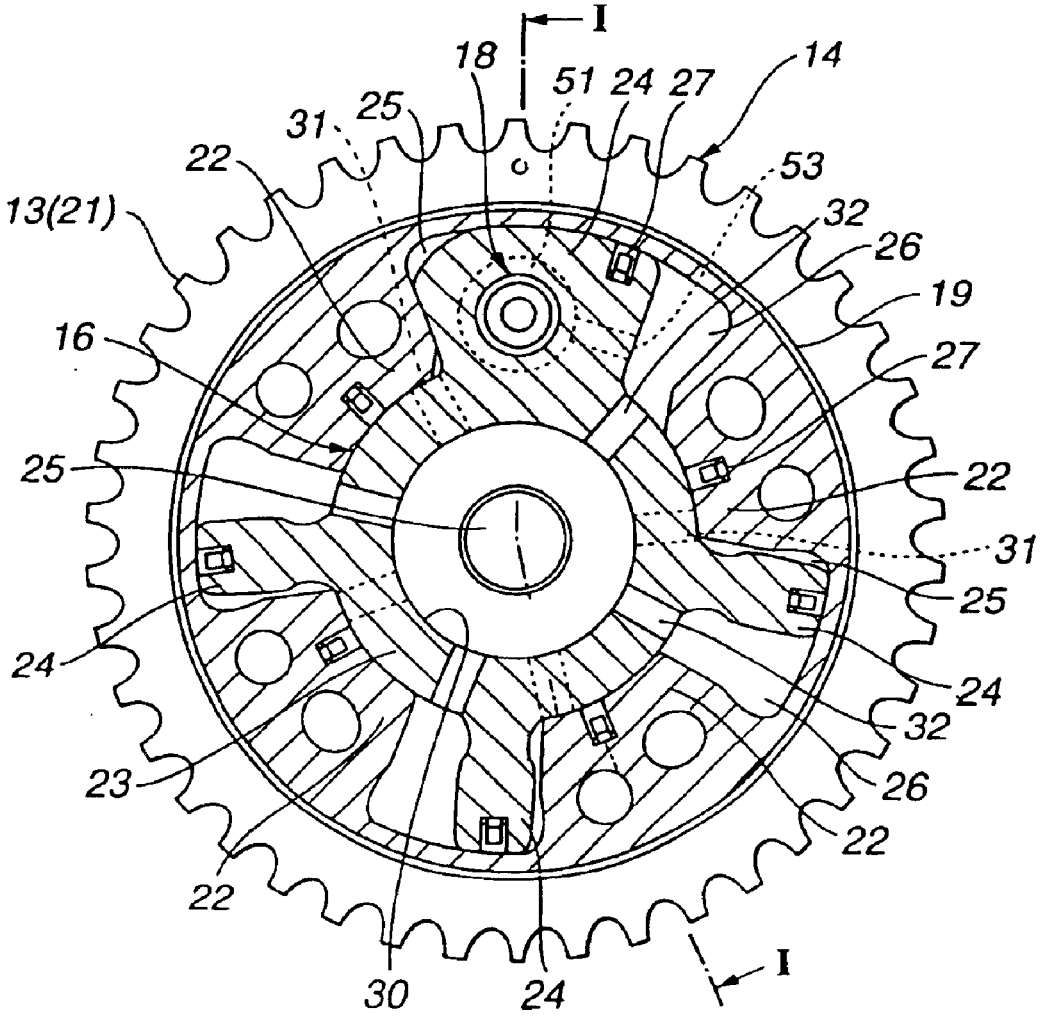
FIG. 2 is a cross section taken along lines II—II in FIG. 1, according to the first embodiment.

Housing 14 is provided with a housing body 19, a front cover 20 and a rear cover 21. Housing body 19 is substantially cylindrical. Housing body 19 has a forward end coupled to front cover 20 with a bolt, and a rearward end coupled to rear cover 21 with a bolt. Moreover, as is seen in FIG. 2, housing body 19 defines an internal surface formed with four partition walls 22 disposed at regular angular internals of 90°. Each of four partition walls 22 has a cross section substantially trapezoidal, and forms a protrusion.

On the other hand, vane rotor 16 is provided with a shell section 23 and four vane sections 24, as is seen in FIG. 2. Shell section 23 is substantially cylindrical, and is coupled (mated) to the forward end (left end in FIG. 1) of cam shaft 10 with cam bolt 15. Four vane sections 24 are protrusions which are disposed radially on an external periphery of shell section 23 at regular angular intervals of 90°. Shell section 23 is disposed in an axial center of housing 14. Each of four vane sections 24 is disposed between two adjacent partition walls 22 of housing 14. There is defined an advanced angle chamber 25 between a first side of vane section 24 of vane rotor 16, and partition wall 22 facing the first side of vane section 24. There is defined a delayed angle chamber 26 between a second side (opposite to the first side) of vane section 24 of vane rotor 16, and partition wall 22 facing the second side of vane section 24. Therefore, in total, valve timing control system 12 is provided with four pairs of advanced angle chamber 25 and delayed angle chamber 26. Each of vane section 24 and partition wall 22 has a head end for mounting a seal member 27 which is biased by a spring, to thereby keep oil tightness between advanced angle chamber 25 and delayed angle chamber 26 adjacent to advanced angle chamber 25.

Moreover, shell section 23 of vane rotor 16 has a forward end (left end in FIG. 1) formed with a protrusion shaft 28 penetrating through a center area of front cover 20 of housing 14. There is defined a connection hole 30 from a head end surface of protrusion shaft 28 to substantially a center of shell section 23, as is seen in FIG. 1. Connection hole 30 has a bottom section (right end in FIG. 1) in which a head section of cam bolt 15 is so disposed as to couple vane rotor 16 to cam shaft 10. Connection hole 30 has an internal surface which is open to an end of each of a first radial hole 31 and a second radial hole 32. First radial hole 31 communicates to advanced angle chamber 25, while second radial hole 32 communicates to delayed angle chamber 26. The end (open to connection hole 30) of first radial hole 31 is axially (horizontally in FIG. 1) shifted from the end (open to connection hole 30) of second radial hole 32.

Moreover, there is provided a supply-drain passage shaft 29 which is inserted into connection hole 30 of vane rotor 16. Supply-drain passage shaft 29 is substantially cylindrical, and extends to a front side cover (not shown) of the internal combustion engine. Supply-drain passage shaft 29 rotates relative to connection hole 30. Operating oil is supplied to and drained from advanced angle chamber 25 and delayed angle chamber 26 through supply-drain passage shaft 29, which is to be described in detail later.

As is seen in FIG. 1, oil pressure conveyer 17 has two oil pressure passages, namely, a first oil pressure passage 33 for supplying the oil pressure to and draining the oil pressure from advanced angle chamber 25, and a second oil pressure passage 34 for supplying the oil pressure to and draining the oil pressure from advanced angle chamber 26. Each of first oil pressure passage 33 and second oil pressure passage 34 is connected to a supply passage 35 and a drain passage 36 by way of an electromagnetic switch valve 37. Electromagnetic switch valve 37 switches first oil pressure passage 33 with second oil pressure passage 34. Supply passage 35 is provided with an oil pump P for force-feeding the oil in an oil pan 38. Drain passage 36 has an end communicating into the oil pan 38. Moreover, a controller 39 controls electromagnetic switch valve 37. Controller 39 receives various input signals such as rotation signals of cam shaft 10 and the crank shaft, and operating conditions of the internal combustion engine (including load, temperature and the like).

First oil pressure passage 33 is formed with a first shaft hole 40, a third radial hole 41, a toroidal groove 42, and first radial hole 31 (of vane rotor 16). First shaft hole 40 is so formed as to run from the front side cover (not shown) of the internal combustion engine axially along supply-drain passage shaft 29. Third radial hole 41 is formed in the vicinity of a head end (right end in FIG. 1) of supply-drain passage shaft 29 in such a manner as to cross with first shaft hole 40. Toroidal groove 42 is formed on an external periphery of supply-drain passage shaft 29 in such a manner as to communicate to third radial hole 41. First radial hole 31 communicates toroidal groove 42 to each of advanced angle chambers 25.

Second oil pressure passage 34 is formed with a second shaft hole 43, a bottom chamber 44, and second radial hole 32 (of vane rotor 16). Second shaft hole 43 is so formed as to run axially along supply-drain passage shaft 29, and communicates to the bottom section (right end in FIG. 1) of connection hole 30. Bottom chamber 44 is formed between the bottom section of connection hole 30, and supply-drain passage shaft 29. Second radial hole 32 communicates bottom chamber 44 to each of delayed angle chambers 26.

Thereby, the operating oil is supplied to and drained from, selectively, advanced angle chamber 25 and delayed angle chamber 26 (each of which is disposed in housing 14) by way of, respectively, first oil pressure passage 33 and second oil pressure passage 34 (each of which is formed from supply-drain passage shaft 29 to vane rotor 16). Moreover, toroidal groove 42 on the external periphery of supply-drain passage shaft 29 is put between one seal ring 45 (left in FIG. 1) and a pair of two seal rings 45 (right in FIG. 1). Seal ring 45 acts as a seal member, and is made of rubber or resin. Seal rings 45 seal an area between supply-drain passage shaft 29 and connection hole 30, and isolates first oil pressure passage 33 from second oil pressure passage 34 in connection hole 30.

According to the first embodiment, housing 14, vane rotor 16, advanced angle chamber 25, delayed angle chamber 26, oil pressure conveyer 17 and the like constitute a rotation control mechanism for controlling rotation of chain sprocket 13 (drive force transmitter) relative to cam shaft 10.

Lock mechanism 18 is provided with a lock pin 47, a spring 48, a spring support pin 49, and a lock hole 50. Lock pin 47 is received in a cylinder hole 46 which is defined axially along one of the vane sections 24 of vane rotor 16. Lock pin 47 is movable forward and rearward in cylinder hole 46. Spring 48 is received in cylinder hole 46, and biases lock pin 47 toward front cover 20. Spring support pin 49 supports an opposite end of spring 48 in cylinder hole 46. Lock hole 50 is defined inside front cover 20. Lock hole 50 engages with a head end of lock pin 47 in a position where vane rotor 16 is displaced on the most delayed angle side relative to housing 14.

Cylinder hole 46 of vane rotor 16 is reduced in diameter stepwise (having a stepped section) on a side defining front cover 20. There is formed a flange member 52 on an external periphery of a bottom section of lock pin 47. There is defined a toroidal space 51 between flange member 52, and the stepped section of cylinder hole 46. As is seen in FIG. 2, toroidal space 51 communicates to delayed angle chamber 26 by way of connection passage 53 which is formed in vane section 24. On the other hand, lock hole 50 has a bottom section connected to an unlock passage 54 which communicates to advanced angle chamber 25. When lock pin 47 engages with lock hole 50, the oil pressure of advanced angle chamber 25 acts on the head end of lock pin 47. Flange member 52 has an area for receiving the oil pressure of delayed angle chamber 26, while the head end of lock pin 47 has an area for receiving the oil pressure of advanced angle chamber 25. According to the first embodiment, the oil pressure receiving area of flange member 52 is substantially the same as the oil pressure receiving area of the head of lock pin 47. A chamber behind lock pin 47 is kept at an atmospheric pressure by way of a passage (not shown).

When the operating oil acting on vane section 24 of vane rotor 16 is not high enough in pressure (such as when the internal combustion engine is started), lock mechanism 18 mechanically locks the rotation of housing 14 relative to vane rotor 16 in a condition that vane rotor 16 is rotated on the most delayed angle side. Then, the operating oil becomes high in pressure to such an extent that the operating oil (high pressure) of advanced angle chamber 25 is introduced into lock hole 50. Then, lock pin 47 is released from lock hole 50, to thereby rotate vane rotor 16.

When vane rotor 16 is so controlled as to rotate from the advanced angle side to the delayed angle side, the operating oil applied to the head end of lock pin 47 is not high in pressure (namely, the operating oil in advanced angle chamber 25 is low in pressure). Thereby, the head end of lock pin 47 is likely to be pushed toward front cover 20 by dint of spring 48. However, at this point in time, the operating oil (high pressure) of delayed angle chamber 26 acts on flange member 52 of lock pin 47, and keeps lock pin 47 backward with the high pressure. With this, lock pin 47 does not prevent vane rotor 16 from rotating on the delayed angle side.

Figure 3:
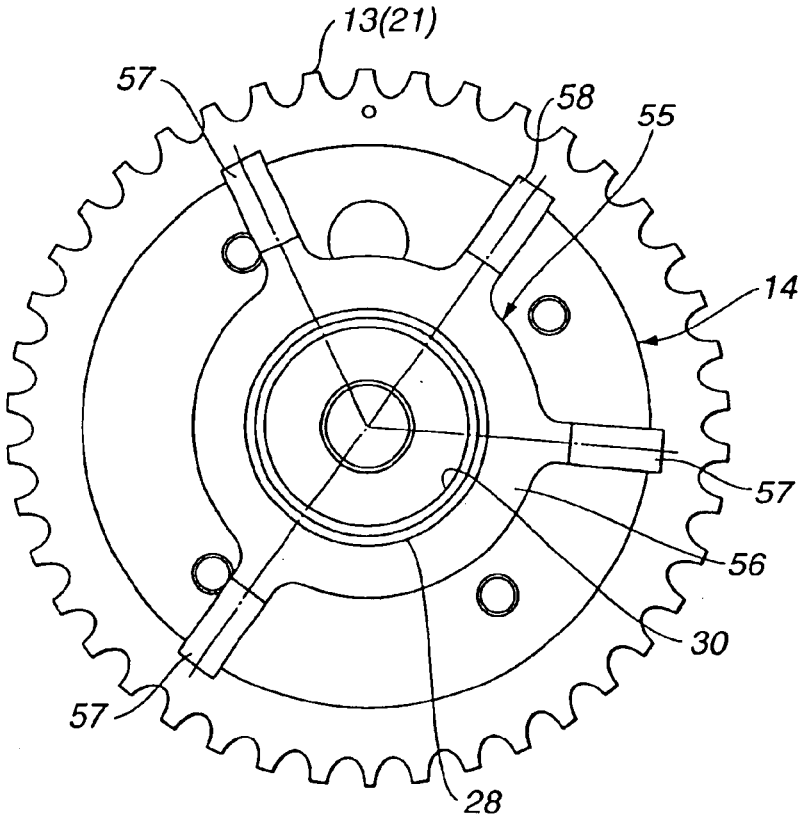
FIG. 3 is a part of valve timing control system 12 viewed in the direction III, VI in FIG. 1, according to the first embodiment.
Figure 4:
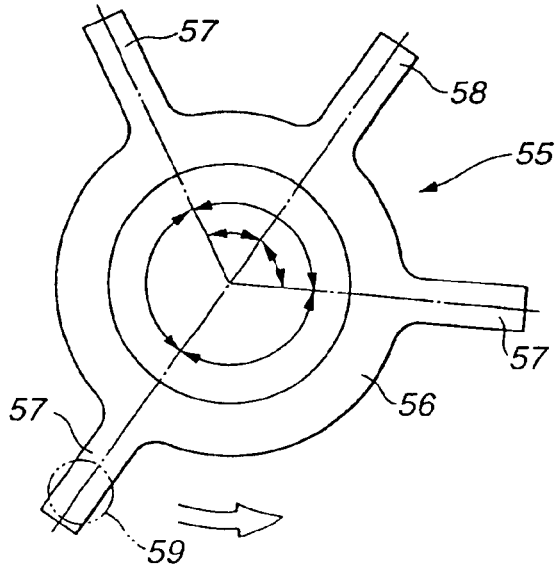
FIG. 4 is a front view of a target plate 55, according to the first embodiment.

Protrusion shaft 28 protruding forward from a forward end (left in FIG. 1) of housing 14 fixedly engages with a target plate 55 made of metal. Target plate 55 detects rotational position of cam shaft 10, and has a configuration entirely flat (in other words, free of bending or winding). Target plate 55 is formed through a press molding. As is seen in FIG. 3 and FIG. 4, target plate 55 has a fitting base 56, a detector protrusion 57, and an index protrusion 58. Fitting base 56 is substantially circular, and engages with protrusion shaft 28. Fitting base 56 has an external periphery formed with detector protrusion 57 (three in number) protruding radially, and index protrusion 58 (one in number) protruding radially. All three detector protrusions 57 and one index protrusion 58 are the same in width. Three detector protrusions 57 are disposed at regular angular intervals circumferentially. Index protrusion 58 is disposed between two predetermined adjacent detector protrusions 57.

Moreover, there is provided a sensor 59 (such as electromagnetic pick up type) in a position opposite to a front surface (left in FIG. 1) on an external periphery of target plate 55 of the internal combustion engine. Sensor 59 senses (detects) a change in magnetic flux attributable to movement of detector protrusion 57 and index protrusion 58. Sensor 59 processes sensed voltage wave form into a rectangular pulse. The thus obtained rectangular pulse shows a change in pulse interval for detecting precise (and/or accurate) rotational position of target plate 55 (or rotational position of cam shaft 10).

In terms of pulse width: As is seen in FIG. 3 and FIG. 4, all three detector protrusions 57 and one index protrusion 58 are the same in width, therefore, all the rectangular pulses are also the same in width for the same rotational speed.

Figure 5:
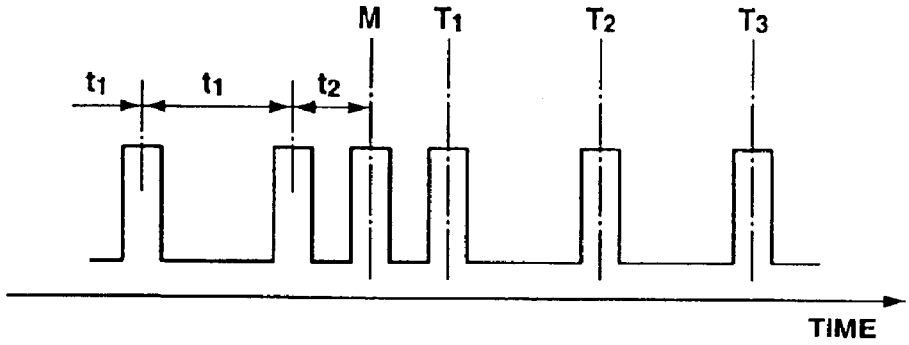
FIG. 5 is a time chart showing signals outputted from a sensor 59, according to the first embodiment.

In terms of pulse interval: An angular interval between index protrusion 58 and adjacent detector protrusion 57 is narrower than an angular interval between two adjacent detector protrusions 57. Therefore, as is seen in FIG. 5, a second pulse internal t2 ending at a middle time point M is narrower than a first pulse interval t1. First pulse interval t1 is a period from the time detector protrusion 57 runs across a front surface (right end surface in FIG. 1) of sensor 59 to the time next detector protrusion 57 runs across the front surface of sensor 59. On the other hand, second pulse interval t2 is a period from the time detector protrusion 57 runs across the front surface of sensor 59 to the time index protrusion 58 runs across the front surface of sensor 59.

Based on the above two paragraphs in terms of the pulse width and the pulse interval, the rotational position of index protrusion 58 of target plate 55 is determined precisely (and/or accurately). With the rotational position of index protrusion 58 thus determined, counting the number of pulses of detected index protrusion 58 determines precisely (and/or accurately) the rotational position of the other detector protrusions 57. In FIG. 5, each of a first time point T1, a second time point T2, and a third time point T3 indicates a point in time when one of respective three detector protrusions 57 runs across the front surface of sensor 59.

Moreover, each of detector protrusion 57 and index protrusion 58 of target plate 55 has a side surface (left end surface in FIG. 1) facing sensor 59. The above side surface has a radial external periphery which is so thinned as to form a stepwise cross section. In other words, an internal periphery (engaging with cam shaft 10) of the side surface of target plate 55 is thicker than the external periphery (facing sensor 59) of the side surface of target plate 55.

Although not described in detail herein, the crank shaft has a crank angle sensor (known art) for detecting rotational position the crank shaft.

Described hereinafter is an operation of the valve timing control system 12.

When the internal combustion engine is started, lock mechanism 18 mechanically locks vane rotor 16 and housing 14 with vane rotor 16 rotationally delayed relative to housing 14. In this condition, rotational force of the crank shaft is transmitted to cam shaft 10 by way of chain sprocket 13 and the rotation control mechanism. Thereby, at this point in time, cam shaft 10 opens and closes the engine valve at the delayed angle timing.

After the internal combustion engine is started in this condition, electromagnetic switch valve 37 is so operated as to communicate supply passage 35 to advanced angle chamber 25, and simultaneously drain passage 36 to delayed angle chamber 26. The operating oil (high pressure) introduced into advanced angle chamber 25 acts on the head end of lock pin 47 by way of unlock passage 54. The thus introduced operating oil moves lock pin 47 backward in cylinder hole 46. With this, the mechanical locking of vane rotor 16 and housing 14 by means of lock mechanism 18 is released, to thereby apply the pressure of advanced angle chamber 25 to vane rotor 16. With the thus applied pressure, vane rotor 16 rotates toward the advanced angle side relative to housing 14. As a result, cam shaft 10 opens and closes the engine valve at the advanced angle timing.

On the contrary, from the above condition, electromagnetic switch valve 37 is so operated as to communicate supply passage 35 to delayed angle chamber 26, and simultaneously drain passage 36 to advanced angle chamber 25. Then, the pressure of delayed angle chamber 26 is applied to vane rotor 16. With the thus applied pressure, vane rotor 16 rotates toward the delayed angle side relative to housing 14. As a result, cam shaft 10 opens and closes the engine valve at the delayed angle timing.

When the internal combustion engine is in operation, the rotational angle of cam shaft 10 is detected by target plate 55 in cooperation with sensor 59. On the other hand, the rotational angle of the crank shaft is detected by the crank angle sensor (known art). Based on the thus obtained two rotational angles, controller 39 determines rotational phase of the crank shaft relative to cam shaft 10. Then, valve timing control system 12 receives an instruction from controller 39. With the thus received instruction, valve timing control system 12 operates the rotation control mechanism as described above, so as to cause the optimum opening and closing timing in accordance with the operation of the internal combustion engine.

Figure 14:
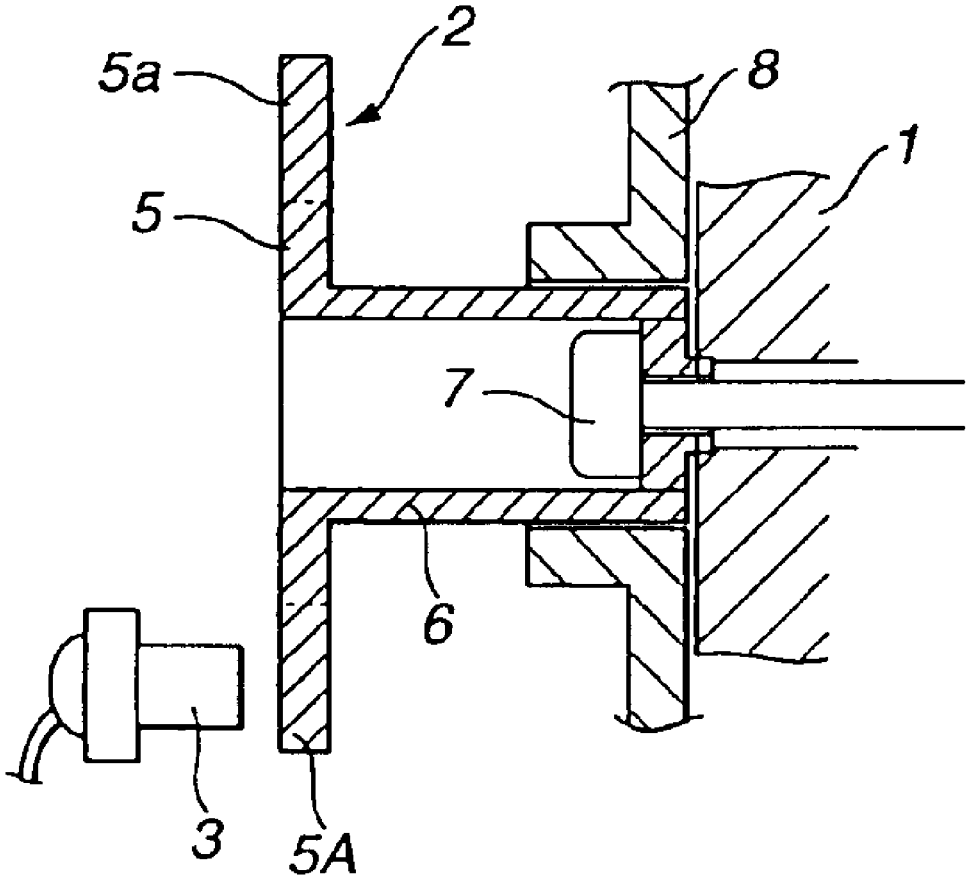
FIG. 14 is a cross section of a part of a valve timing control system, according to a related art.

Valve timing control system 12 according to the first embodiment is formed as described in the following two sentences: Target plate 55 is formed flat through the press molding. Then, for fixation, target plate 55 is press fitted to protrusion shaft 28 formed on vane rotor 16. Thereby, target plate 55 is formed more easily and precisely (and/or accurately) than a target plate 2 of a valve timing control system according to Japanese Patent Unexamined Publication No. Heisei 10 (1998)-252420 (in which target plate 2 is integrally formed with a bottomed cylindrical wall 6 having a bottom section which is coupled to a vane rotor 1 with a cam bolt 7), as is seen in FIG. 14. In other words, target plate 55 of valve timing control system 12 according to the present invention does not require a drawing during the press molding. Namely, only one punching (or blanking) is enough for forming the entire part of target plate 55 with high precision (and/or accuracy).

According to the present invention, however, target plate 55 requires another machining of thinning the head end of detector protrusion 57 and the head end of index protrusion 58. In this case, however, the entire part of target plate 55 can be reduced in weight, without reducing strength or stability for fitting the internal periphery (of target plate 55) to protrusion shaft 28. Moreover in this case, any rotational shift (of target plate 55) attributable to inertial force can be prevented, and sensor 59 can be disposed nearer to cam shaft 10. In other words, sensor 59 can be disposed more freely, to thereby reduce the entire internal combustion engine in size.

Moreover, other than the "press" fitting according to the first embodiment, a bolt and the like also can be used for fitting target plate 55 to protrusion shaft 28. However, the "press" fitting according to the first embodiment allows an easier and more precise (and/or accurate) fitting of target plate 55 to protrusion shaft 28 only by controlling press fitting stroke.

Furthermore, according to the first embodiment, supply-drain passage shaft 29 is inserted into connection hole 30 which is formed from the head end surface of protrusion shaft 28 to substantially the center of shell section 23 of vane rotor 16, and seal rings 45 fitted to supply-drain passage shaft 29 are in a close contact with the internal periphery (which is free of steps or joints) of connection hole 30. Thereby, failures are prevented such as shift of seal rings 45, oil leak attributable to the shift of seal rings 45, and decrease in durability (of seal rings 45) attributable to edge abutment.

In other words, if vane rotor 16 does not secure a sufficient allowance for inserting supply-drain passage shaft 29, supply-drain passage shaft 29 has no choice, for insertion, but to stride over "other members" such as housing 14. The stride of supply-drain passage shaft 29 involves a stride of seal rings 45 over the above other members. With this, the failures are likely to occur such as the shift of seal rings 45, the oil leak attributable to the shift of seal rings 45, and the decrease in durability of seal rings 45. As described in the former paragraph, such failures can be prevented, according to the first embodiment of the present invention.

According to the first embodiment, target plate 55 has the following features: Target plate 55 has three detector protrusions 57 which have the same width each other and are disposed at regular angular intervals. Moreover, index protrusion 58 having the same width as that of detector protrusion 57 is disposed between adjacent two of detector protrusions 57. Sensor 59 detects the reduction in the pulse interval, which reduction is regarded as an index for determining the position of index protrusion 58. At this point in time, sensor 59 starts counting the number of pulses, so as to determine precisely (and/or accurately) the position of each of detector protrusions 57.

Contrary to target plate 55 according to the first embodiment of the present invention, the target plate according to Japanese Patent Unexamined Publication No. Heisei 10 (1998)-252420 has one protrusion having a width that is greater, for discrimination, than that of the other protrusions.

Therefore, the entire part of target plate 55 according to the first embodiment is lighter in weight than target plate 2 according to Japanese Patent Unexamined Publication No. Heisei 10 (1998)-252420, as is seen in FIG. 14. From this point of view, target plate 55 is prevented from causing the rotational shift.

The arrangement of detector protrusions 57 and index protrusion 58 of target plate 55 (flat), and the mechanism that sensor 59 detects precisely (and/or accurately) the position of index protrusion 58 and detector protrusion 57 based on the pulse interval are applicable to another type of target plate that is not flat. More specifically, the above arrangement and the mechanism are applicable to the another type of target plate that is integrally formed with a bottomed cylindrical wall. Moreover, for use of the mechanism having the another type of target plate formed with the bottomed cylindrical wall, other types of rotation control mechanism (other than the vane type) is applicable for controlling rotation of the drive force transmitter (chain sprocket 13) relative to cam shaft 10. More specifically, included in the other types is a combination of an oil pressure piston (direct drive type) and a converter gear (by means of a helical spline).

Moreover, the rotational position of the crank shaft is allowed to be indirectly detected referring to the rotational position of housing 14, by fitting housing 14 with target plate 55 and fitting the internal combustion engine with sensor 59 (opposing target plate 55).

Figure 6:
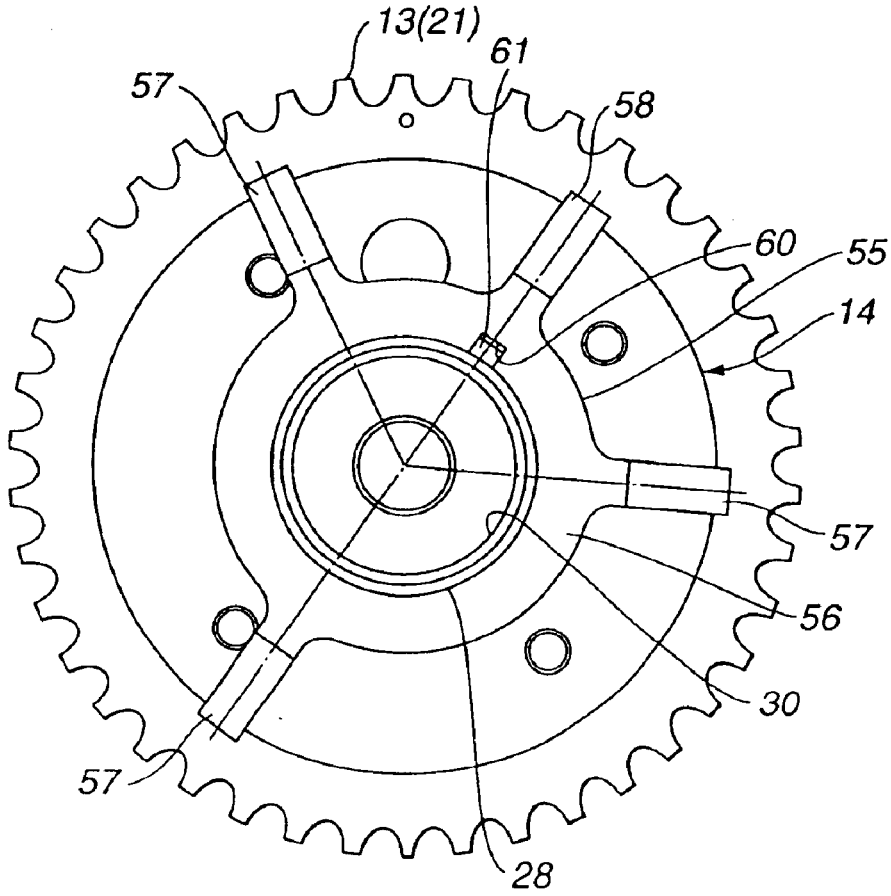
FIG. 6 is a part of a valve timing control system equivalent to the one viewed in the direction III, VI in FIG. 1, according to a second embodiment of the present invention.
Figure 7:
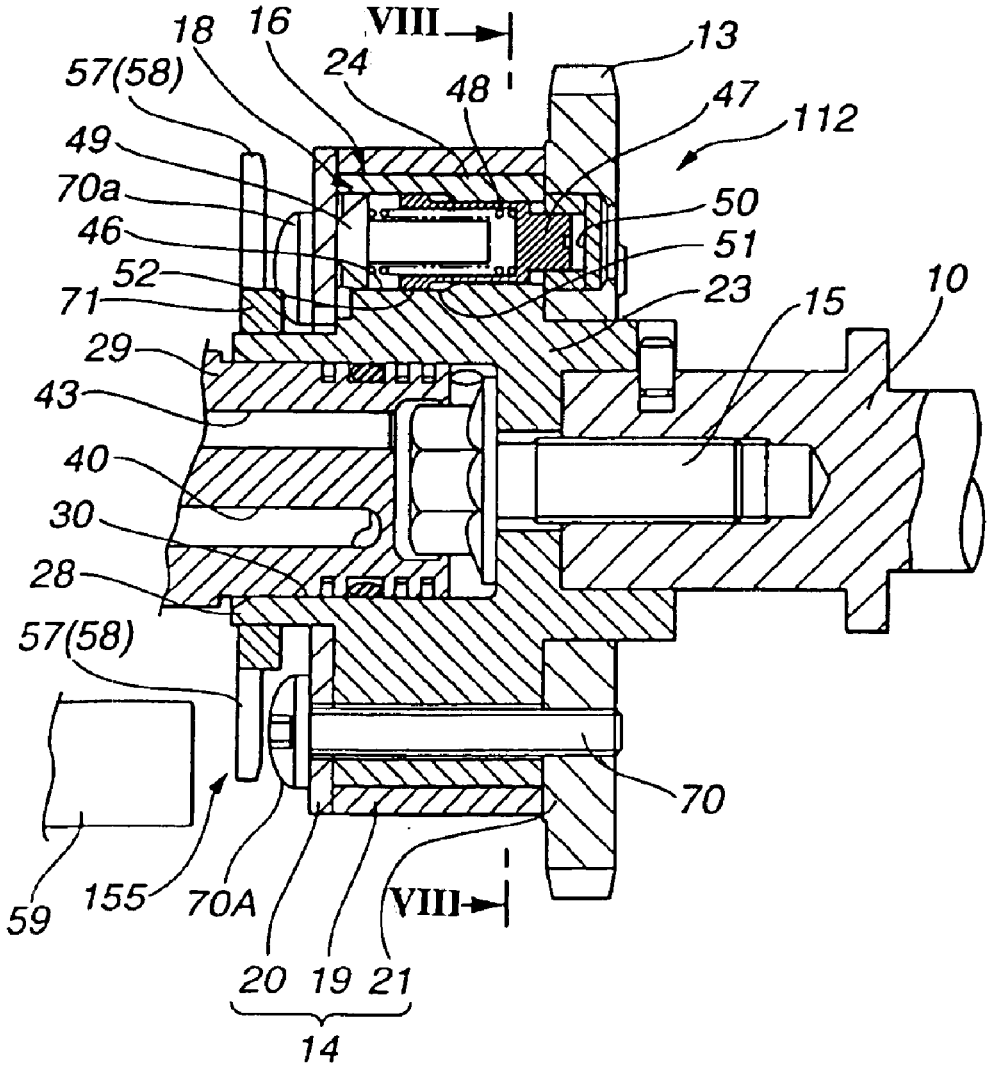
FIG. 7 is an overall view of a valve timing control system 112 showing a cross section taken along lines VII—VII is FIG. 8, according to a third embodiment of the present invention.
Figure 8:
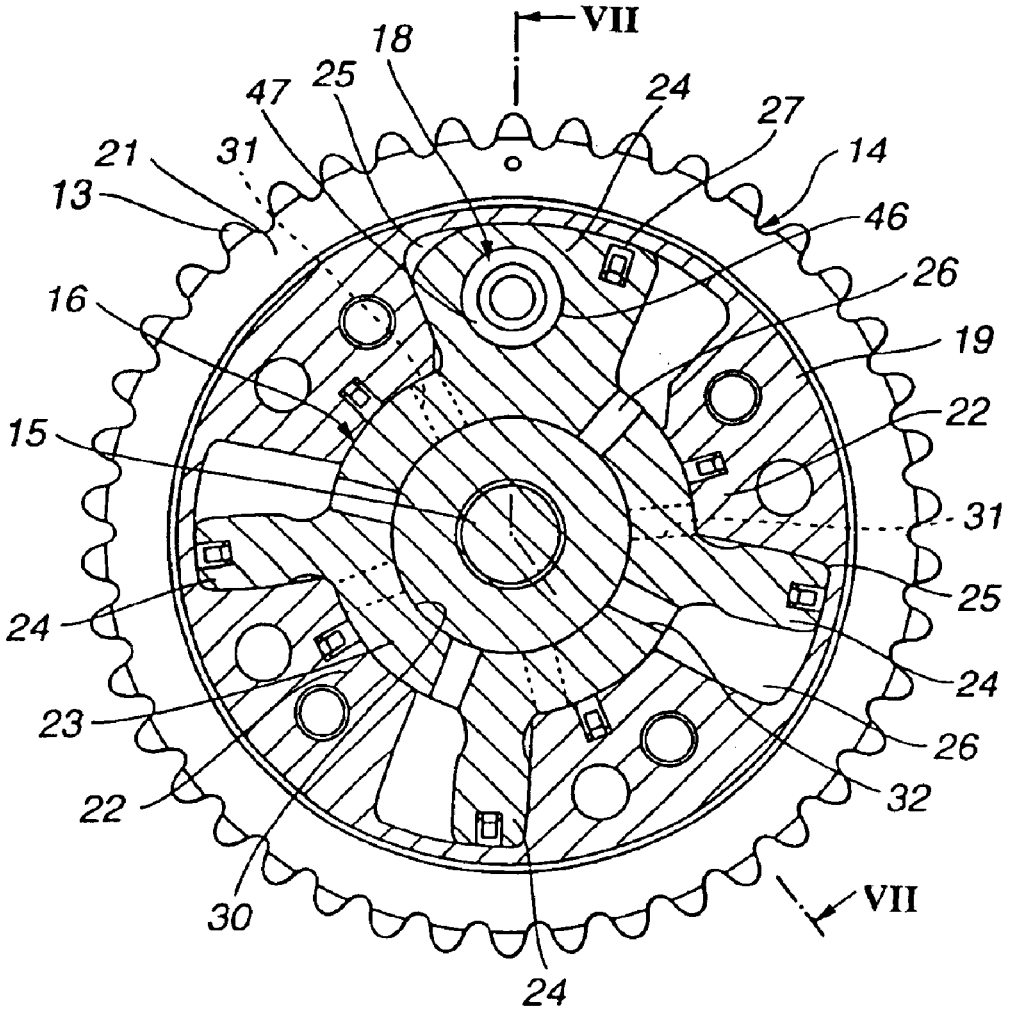
FIG. 8 is a cross section taken along lines VIII—VIII in FIG. 7, according to the third embodiment.
Figure 9:
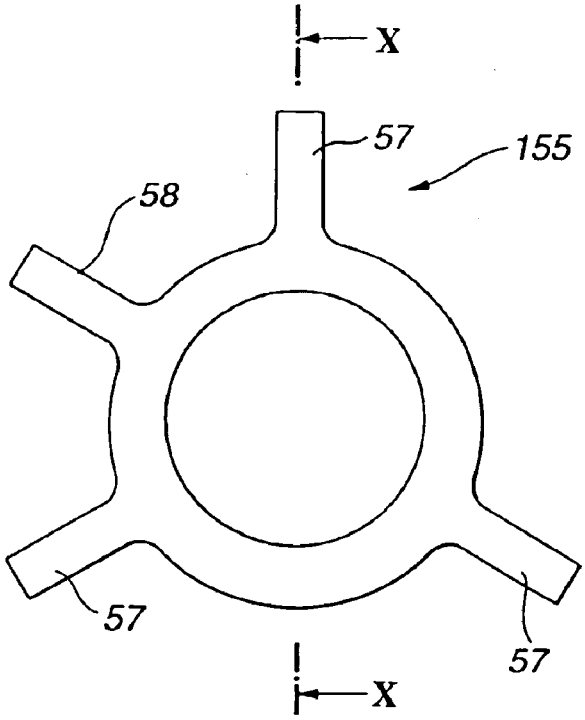
FIG. 9 is a front view of a target plate 155, according to the third embodiment.
Figure 10:
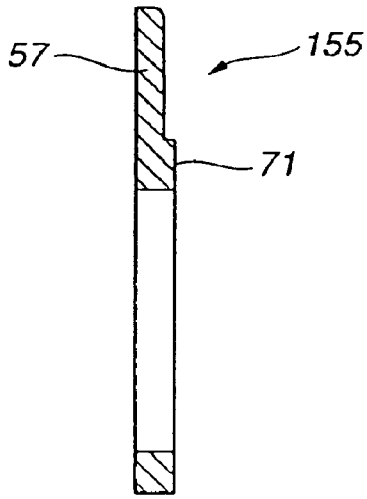
FIG. 10 is a cross section of target plate 155, taken along lines X—X in FIG. 9.

As is seen in FIG. 6, there is provided a valve timing control system for the internal combustion engine, according to a second embodiment of the present invention.

There is provided a key slot 60 on the internal periphery of target plate 55. Key slot 60 stops rotation. More specifically, a key 61 is inserted into key slot 60, to thereby assuredly stop target plate 55 from causing the rotational shift relative to protrusion shaft 28.

As is seen in FIG. 7 to FIG. 10, there is provided a valve timing control system 112 for the internal combustion engine, according to a third embodiment of the present invention. In FIG. 7 to FIG. 10, parts and sections substantially the same are denoted by the same numerals, and repeated descriptions are omitted.

Valve timing control system 112 according to the third embodiment is substantially the same as valve timing control system 12 according to the first embodiment, in terms of overall fundamental constitution. Valve timing control system 112 is, however, different from valve timing control system 12 in the following four points: i. Arrangement of lock hole 50, lock pin 47 and the like of lock mechanism 18. ii. Arrangement of a head section 70A of a bolt 70 for coupling three members, that is, housing body 19, front cover 20 and rear cover 21. iii. Configuration of a target plate 155. iv. How to fit target plate 155 to protrusion shaft 28.

More specifically, like in the first embodiment, lock pin 47 engages with lock hole 50 in the position where vane rotor 16 is displaced on the most delayed angle side relative to housing 14. Lock hole 50 is defined on an inside of rear cover 21. Lock pin 47 has the head end extending toward rear cover 21 in such as manner as to engage with lock hole 50. In accordance with this, spring support pin 49 is received in cylinder hole 46 in such as manner as to be deflected toward front cover 20. Spring 48 biases lock pin 47 toward rear cover 21. Moreover, there is provided bolt 70 having head section 70A which is disposed on a front side of front cover 20. The disposition of head section 70A is based on a mounting method through which bolt 70 and lock pin 47 are mounted in the same direction by means of a mounting device (not shown).

Like target plate 55 according to the first embodiment, target plate 155 has a configuration substantially entirely flat. Target plate 155 has an internal periphery which is formed with a boss section 71 extending (embossed) toward front cover 20 (namely, a root of protrusion shaft 28). Boss section 71 is fixedly press fitted to an external periphery around a head end of protrusion shaft 28. Like target plate 55 according to the first embodiment, the external periphery of boss section 71 of target plate 155 has radial protrusions, that is, detector protrusion 57 three in number and index protrusion 58 one in number. Boss section 71 has an external diameter which defines such an end as not to interfere with head section 70A of bolt 70.

As described above, valve timing control system 112 has target plate 155 which is formed with boss section 71. Thereby, target plate 155 has an allowance that is sufficient for press fitting to protrusion shaft 28, to thereby improve rigidity of target plate 155 fitted to protrusion shaft 28. Therefore, during rotation target plate 155 does not cause wobble, to thereby improve detection precision (and/or accuracy) by means of sensor 59.

Furthermore, in valve timing control system 112, boss section 71 is so press fitted to protrusion shaft 28 as to extend toward front cover 20, causing the following effects: Enlargement of entire valve timing control system 112 (including target plate 155) in the axial direction is not necessary. Detector protrusion 57 and index protrusion 58 are spaced apart sufficiently from front cover 20. Any interference (of detector protrusion 57 and index protrusion 58) with other members such as bolt 70 is assuredly prevented.

Figure 11:
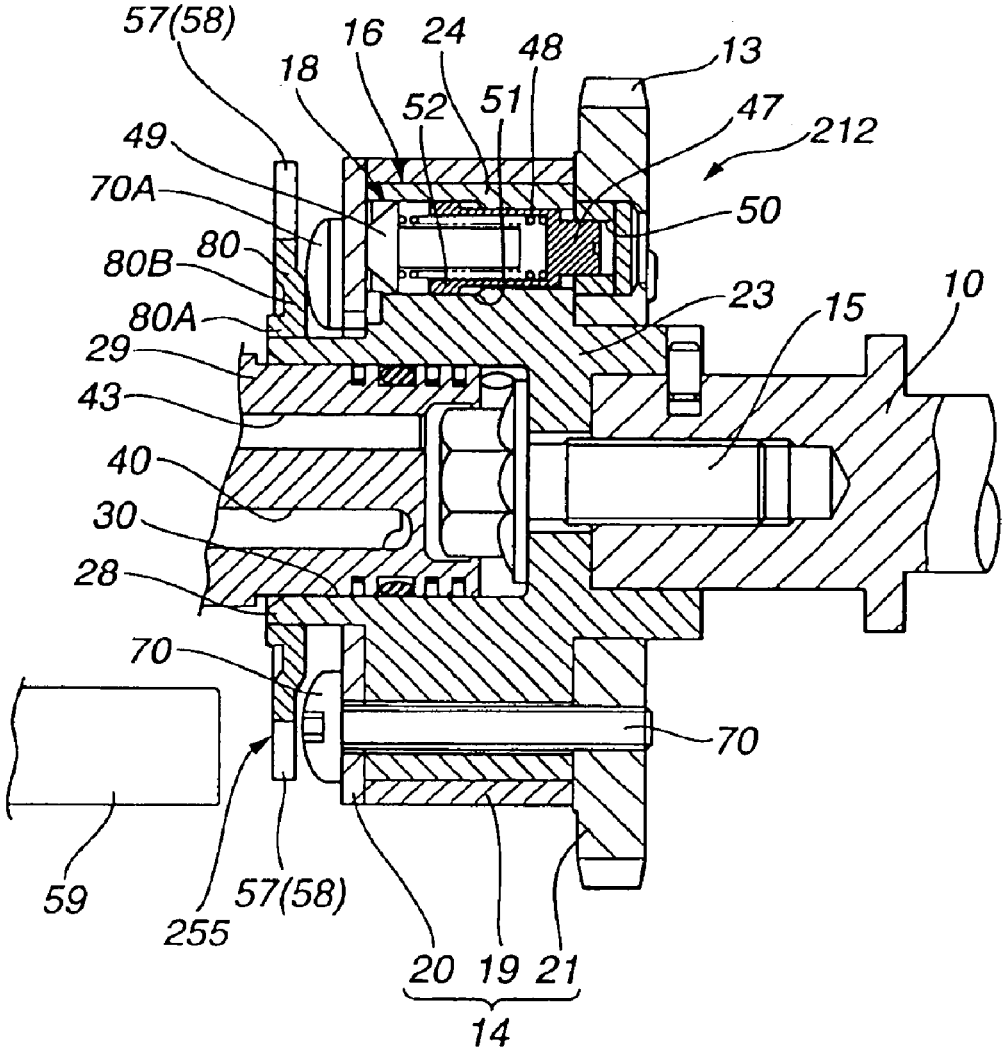
FIG. 11 is an overall view of a valve timing control system 212, according to a fourth embodiment of the present invention, in which the over all view is equivalent to the one in FIG. 7.
Figure 12:
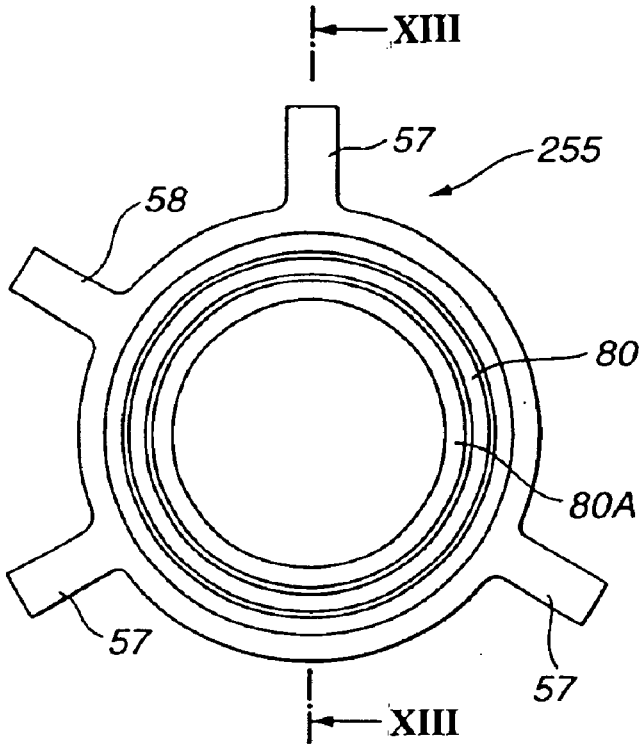
FIG. 12 is a front view of a target plate 255, according to the fourth embodiment.
Figure 13:
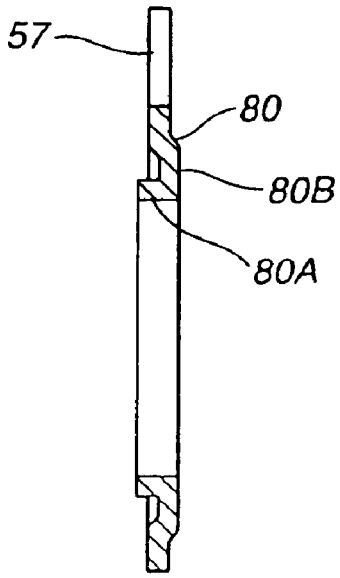
FIG. 13 is a cross section of target plate 255, taken along lines XIII—XIII in FIG. 12.

As is seen in FIG. 11 to FIG. 13, there is provided a valve timing control system 212 for the internal combustion engine, according to a fourth embodiment of the present invention. In FIG. 11 to FIG. 13, parts and sections substantially the same are denoted by the same numerals, and repeated descriptions are omitted.

Valve timing control system 212 according to the fourth embodiment is substantially the same as valve timing control system 112 according to the third embodiment, in terms of overall constitution. Valve timing control system 212 has a target plate 255 which has configuration and constitution a little different from those of target plate 155 of valve timing control system 112.

Target plate 255 is a plate material which is substantially constant in thickness overall. Moreover, there is provided an internal periphery 80 which is so bent through press molding as to form a cross section shaped substantially into alphabetical U (or J), as is seen in FIG. 13. Internal periphery 80 has an inner cylindrical wall 80A and a bottom section 80B. Target plate 255 is fixedly press fitted to protrusion shaft 28 in such a manner that inner cylindrical wall 80A allows bottom section 80B to face front cover 20.

Valve timing control system 212 according to the fourth embodiment secures a sufficient press fitting allowance with inner cylindrical wall 80A, and keeps high rigidity with inner cylindrical wall 80A having the cross sectional shape of alphabetical U (or J). The sufficient press fitting allowance and the high rigidity are not influenced even when target plate 255 is thin in overall thickness for lighter weight. Therefore, target plate 255 can be lighter in weight without reducing rigidity of target plate 255 fitted to protrusion shaft 28.

Furthermore, according to the fourth embodiment, target plate 255 is press fitted to protrusion shaft 28 from bottom section 80B of internal periphery 80. Thereby, an edge defined on bottom section 80B (slightly bent through the press molding) is brought into abutment on the external periphery of protrusion shaft 28 during the press fitting. With this, cylindrical wall 80A does not scratch the external surface of protrusion shaft 28. As a result, target plate 255 is smoothly press fitted to protrusion shaft 28, to thereby assuredly improve workability (assembly).

Although the present invention has been described above by reference to four embodiments, the present invention is not limited to the four embodiments described above. Modifications and variations of the embodiments described above will occur to those skilled in the art, in light of the above teachings.

The entire contents of basic Japanese Patent Application No. P2000-360519 (filed Nov. 28, 2000) of which priority is claimed and Japanese Patent Application No. P2001-257302 (filed Aug. 28, 2001) of which priority is claimed are incorporated herein by reference.

The scope of the present invention is defined with reference to the following claims.

What is claimed is:

1. A valve timing control system for an internal combustion engine comprising:

a drive force transmitter driven by means of a crank shaft of the internal combustion engine;

a cam shaft having an external periphery which is formed with a drive cam for operating a valve of the internal combustion engine, the cam shaft being so fitted with the drive force transmitter as to rotate the drive force transmitter relative to the cam shaft when so required, the cam shaft being a follower which is rotated with a drive force transmitted from the drive force transmitter;

a housing rotating integrally with one of the drive force transmitter and the cam shaft;

a vane rotor housed in the housing, and rotating integrally with the other of the drive force transmitter and the cam shaft;

an advanced angle chamber and a delayed angle chamber disposed in the housing, and rotating the vane rotor with an oil pressure;

an oil pressure conveyer communicating to the advanced angle chamber and the delayed angle chamber, the oil pressure conveyer supplying the oil pressure selectively to one of the advanced angle chamber and the delayed angle chamber while draining the oil pressure selectively from the other of the advanced angle chamber and the delayed angle chamber;

a protrusion shaft formed on at least one of the vane rotor and the housing, the protrusion shaft protruding forward;

a target plate mounted on at least the one of the vane rotor and the housing, the target plate being formed substantially flat and fitted to the protrusion shaft; and a sensor disposed in a vicinity of the target plate, the sensor detecting a rotational angle of the target plate, wherein a supply-drain passage shaft is fixedly disposed in the internal combustion engine, the supply-drain passage shaft being for supplying an operation oil to the advanced angle chamber and for draining the operation oil from the advanced angle chamber, and the supply-drain passage shaft being for supplying the operation oil to the delayed angle chamber and for draining the operation oil from the delayed angle chamber;

a connection hole is defined from a head end of the protrusion shaft disposed on the vane rotor to substantially a center of a shell section of the vane rotor;

the supply-drain passage shaft is so inserted into the connection hole as to rotate relative to the connection hole; and a seal ring is disposed between the connection hole and the supply-drain passage shaft.

2. A valve timing control system for an internal combustion engine comprising:

a drive force transmitter driven by means of a crank shaft of the internal combustion engine;

a cam shaft having an external periphery which is formed with a drive cam for operating a valve of the internal combustion engine, the cam shaft being so fitted with the drive force transmitter as to rotate the drive force transmitter relative to the cam shaft when so required, the cam shaft being a follower which is rotated with a drive force transmitted from the drive force transmitter;

a housing rotating integrally with one of the drive force transmitter and the cam shaft;

a vane rotor housed in the housing, and rotating integrally with the other of the drive force transmitter and the cam shaft;

an advanced angle chamber and a delayed angle chamber disposed in the housing, and rotating the vane rotor with an oil pressure;

an oil pressure conveyer communicating to the advanced angle chamber and the delayed angle chamber, the oil pressure conveyer supplying the oil pressure selectively to one of the advanced angle chamber and the delayed angle chamber while draining the oil pressure selectively from the other of the advanced angle chamber and the delayed angle chamber;

a protrusion shaft formed on at least one of the vane rotor and the housing, the protrusion shaft protruding forward;

a target plate mounted on at least the one of the vane rotor and the housing, the target plate being formed substantially flat and fitted to the protrusion shaft; and a sensor disposed in a vicinity of the target plate, the sensor detecting a rotational angle of the target plate, wherein the target plate has an internal periphery which is formed with a boss section embossed axially, and the target plate is press fitted to the protrusion shaft for fixation in such a manner that the boss section is positioned on a side defining a root of the protrusion shaft.

3. A valve timing control system for an internal combustion engine, comprising:

a drive force transmitter driven by means of a crank shaft of the internal combustion engine;

a cam shaft having an external periphery which is formed with a drive cam for operating a valve of the internal combustion engine, the cain shaft being so fitted with the drive force transmitter as to rotate the drive force transmitter relative to the cam shaft when so required, the cam shaft being a follower which is rotated with a drive force transmitted from the drive force transmitter;

a rotation control mechanism disposed between the drive force transmitter and the cam shaft, the rotation control mechanism supplying an oil pressure from an outside and draining the oil pressure to the outside so as to control the drive force transmitter to rotate relative to the cam shaft;

a target plate mounted on at least one of the drive force transmitter and the cam shaft, the target plate comprising:

a plurality of detector protrusions protruding radially outward and disposed at regular angular intervals circumferentially on the target plate, the detector protrusions being substantially equal in width, each two of the detector protrusions defining therebetween a first pulse interval of a detection signal, and one index protrusion protruding radially outward and disposed between two of the detector protrusions that are predetermined and adjacent to the one index protrusion, the one index protrusion being substantially equal in width to any one of the detector protrusions, the one index protrusion and the any one of the detector protrusions defining therebetween a second pulse interval of the detection signal, the second pulse interval being shorter than the first pulse interval; and a sensor for detecting the plurality of the detector protrusions and the one index protrusion of the target plate, so as to detect a rotational position of the drive force transmitter and a rotational position of the cam shaft, by the following steps of:

detecting a point in time when the first pulse interval is reduced to the second pulse interval shorter than the first pulse interval, and determining the point in the time as an arrival of the one index protrusion at a detection position of the sensor.

4. The valve timing control system for the internal combustion engine as claimed in claim 3, in which the target plate has an internal periphery; and each of the detector protrusion and the index protrusion of the target plate protrudes from the internal periphery of the target plate, and is thinner than the internal periphery of the target plate.

5. The valve timing control system for the internal combustion engine as claimed in claim 3, in which the rotation control mechanism comprises:

a housing rotating integrally with one of the drive force transmitter and the cain shaft, a vane rotor housed in the housing, and rotating integrally with the other of the drive force transmitter and the cam shaft, an advanced angle chamber and a delayed angle chamber each of which is disposed in the housing and rotates the vane rotor with the oil pressure; and an oil pressure conveyer communicating to the advanced angle chamber and the delayed angle chamber, the oil pressure conveyer supplying the oil pressure selectively to one of the advanced angle chamber and the delayed angle chamber while draining the oil pressure selectively from the other of the advanced angle chamber and the delayed angle chamber.

6. The valve timing control system for the internal combustion engine as claimed in claim 3, in which the detector protrusions are three in number.

7. The valve timing control system for the internal combustion engine as claimed in claim 3, in which the drive force transmitter is a chain sprocket.

* * * * *